United States Patent [19]

Nuss

[11] 3,996,710

[45] Dec. 14, 1976

[54] SIMPLIFIED OVEN DOOR WINDOW

[75] Inventor: James J. Nuss, Louisville, Ky.

[73] Assignee: General Electric Company, Louisville, Ky.

[22] Filed: Apr. 11, 1975

[21] Appl. No.: 567,374

[52] U.S. Cl. ..... 52/202; 52/304; 52/616; 126/200

[51] Int. Cl.[2] ..... E06B 6/26; F23M 7/00

[58] Field of Search ..... 52/202, 203, 304, 398, 52/456, 616; 126/200, 197, 198

[56] References Cited

UNITED STATES PATENTS

| | | | |
|---|---|---|---|
| 2,009,142 | 7/1935 | Marsh | 52/398 |
| 3,021,832 | 2/1962 | Mills | 52/616 |
| 3,500,815 | 3/1970 | De Weese et al. | 126/200 |
| 3,507,267 | 4/1970 | Lafforgue | 126/200 |
| 3,828,763 | 8/1974 | Wilson | 52/616 |
| 3,842,542 | 10/1974 | White et al. | 49/386 |
| 3,877,460 | 4/1975 | Lotz et al. | 126/200 |
| 3,889,099 | 6/1975 | Nuss | 126/198 |
| 3,889,100 | 6/1975 | Dills | 126/198 |
| 3,893,442 | 7/1975 | Nuss | 126/198 |

*Primary Examiner*—James L. Ridgill, Jr.
*Attorney, Agent, or Firm*—Richard L. Caslin; Francis H. Boos

[57] ABSTRACT

A door construction provided with a window for use with a conventional baking and broiling oven. The window is formed with two glass panes which are widely spaced apart and are mounted independently of each other so there is no direct heat conductive path between the two glass panes. A dust sealing flange is located just beneath the window opening to reduce the opportunity of air-borne soil to reach up between the two glass panes.

6 Claims, 3 Drawing Figures

SIMPLIFIED OVEN DOOR WINDOW

BACKGROUND OF THE INVENTION

1. Field of the Invention:

The invention relates to the construction of a door for a conventional baking and broiling oven, and particularly to a design of a viewing window for the door which will not allow enough heat to escape through the window as might otherwise raise the exterior temperatures of the door to reach unsafe temperature levels.

2. Description of the Prior Art:

For many years the viewing windows of oven doors have comprised a two-pane window pack or subassembly such as is shown in the Mills U.S. Pat. No. 3,021,832. Such a window pack has a pair of glass panes which are spaced apart by a peripheral spacer frame, and the various parts are held together by a continuous clamping and sealing frame. This window pack has a still air space therein for good thermal properties and for sanitary reasons so that the interior surfaces of the glass panes do not become soiled.

As the maximum temperature permitted on the exterior surfaces of the oven door has been reduced in recent years by safety regulating agencies, additional means have been provided to retard the escape of heat through the window. One example is shown in U.S. Pat. No. 3,828,763 of Arthur C. Wilson, which is assigned to the same assignee as is the present invention. Wilson shows a third glass plane on the outer surface of the door which is spaced from the two-pane window pack by a ventilated air channel.

Another design in widespread use is a three-pane window pack that is sealed together in a manner similar to the two-pane window pack.

A principal object of the present invention is to provide a simplified window design for an oven door where the heat loss through the window is reduced over the two-pane and the three-pane window pack designs.

A further object of the present invention is to provide a two-pane window of the class described where there is no direct heat conductive path between the two glass panes.

A further object of the present invention is to provide a window design of the class described with sealing means to prevent the thermal insulation within the door and other air-borne soil from obscuring the view through the window.

SUMMARY OF THE INVENTION

The present invention, in accordance with one form thereof, relates to an oven door construction having a first glass pane mounted in a window opening of the outer door panel, and a second glass pane mounted in a window opening of the inner door liner so that there will be no direct heat conductive path between the two glass panes. A layer of thermal insulation surrounds the window opening, and an insulation guard serves to hold the insulation in place. The insulation guard includes a sealing flange beneath the window opening to retard air flow and hence air-borne soil up between the two glass panes.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
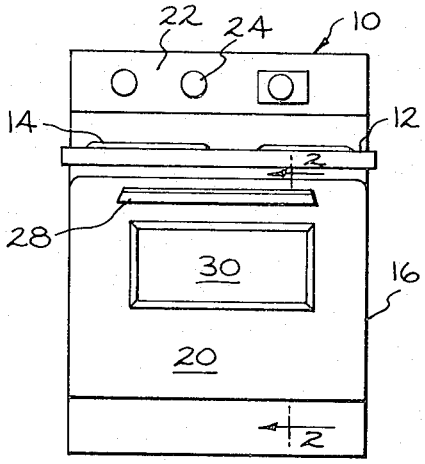
FIG. 1 is a front elevational view of a domestic range having a windowed oven door embodying the present invention.

Turning now to a consideration of the drawings, and in particular to FIG. 1, there is shown for illustrative purposes a free-standing domestic range 10 having a top cooking surface 12 with a plurality of surface heating means 14. A baking and broiling oven 16 is located beneath the cooktop 12, and formed by a box-like oven liner 18 shown in the side view of FIG. 2 and a front-opening drop door 20 of the present invention.

While the oven door of the present invention is shown as being installed on an electric range, it will readily be apparent to those skilled in this art that this invention is not limited to use with an electric range. This invention could just as well be installed on a gas-fired oven. Also, the oven could be a built-in oven, or part of a drop-in range rather than a free-standing range as is illustrated. A back-splash 22 rises from the cooktop 12 along the back edge thereof, and it contains the conventional control components 24 for the surface heating means 14 and the oven heating units (not shown). The control components 24 are illustrated diagrammatically since they do not form part of the present invention.

The oven door 20, as seen in the front view of FIG. 1, is a generally rectangular structure which is adapted to be hinged along its bottom edge to the range body or cabinet structure by hinge straps (not shown) for movement between a vertical closed position and a horizontal fully open position. The door is provided with an elongated handle 28 that is located near its top edge so that the handle may be grasped and the door pulled open or pushed closed with ease. Cooperating with the door hinging means would be a door counterbalancing system (not shown) as is conventional in this art. The door 20 includes a rectangular viewing window 30 that is of reduced size as compared with the overall size of the door front, and it is located generally in the top half of the door structure so that a person standing near the front of the oven may peer down into the oven cooking cavity through the window 30 and observe the food while it is being cooked therein.

Figure 2:
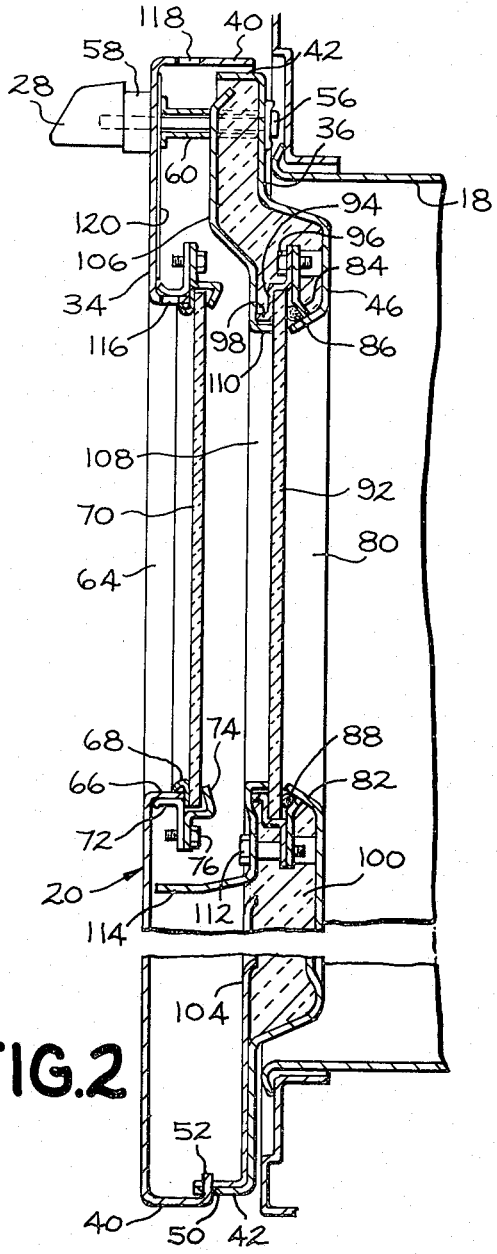
FIG. 2 is a fragmentary cross-sectional side elevational view on an enlarged scale of the oven door of FIG. 1, taken on the line 2—2 of FIG. 1.

As is best seen in FIG. 2, the oven door 20 is of generally sheet metal construction having an outer door panel 34 and an inner door liner 36. The outer door panel 34 is of shallow pan configuration by virtue of the fact that it has a slight rearwardly facing peripheral flange 40. The inner door liner 36 is also of shallow pan configuration since it has a slight frontwardly facing peripheral flange 42 which telescopes slightly within the flange 40 of the outer door panel 34. The central portion 46 of the inner door liner 36 is provided with a rectangular raised embossment 46 which fits into the front opening of the oven liner 18 in the manner of a plug.

Along the lower edge of the door 20, the flange 42 is provided with a plurality of spaced slots 50 each for receiving therein a short vertical tab 52 extending from the flange 40. This tends to hold together the bottom portions of the outer door panel and the inner door liner.

Near the upper edge of the door 20, a long screw 56 is shown extending from the inside of the door, through the inner door liner and out through the outer door panel 34 to be threaded into the door handle 28. A spacer 58 is shown between the outer door panel 34 and the handle 28 so the door handle is thermally insulated from the outer door panel. The long screw 56 is furnished with a tubular spacer 60 which is supported on the screw and braced between the outer door panel 34 and the inner door liner 36 so as to hold the door parts in a spaced relation as shown. The simplest design is to use two long screws 56, one at each end of the handle 28. Thus, to disassemble the door, the two screws 56 are first removed and the top portion of the door opens like a book, while the bottom portion of the door has a hinging action furnished by the slot and tab configuration 50 and 52.

The outer door panel has a rectangular window opening 64 that is defined by a rearwardly turned peripheral flange 66. A decorative trim frame 68 is supported from the flange 66 and a tempered glass pane 70 is placed over the trim frame. A series of spaced brackets 72 are attached to the outside of the flange 66. A Z-shaped clip 74 is attached to each bracket 72 by a screw fastener 76. Each clip has a finger portion which overlies the edge of the glass pane 70 and prevents the pane from moving. In place of the series of clips 74, a continuous frame of about the same transverse cross-section as the clip 74 could also be used.

The inner door liner 36 also has a rectangular window opening 80 that is located in the embossment 46 and defined by an inwardly tapered frontwardly turned peripheral flange 82. An outer window frame 84 encircles the flange 82 and is attached to the inner surface of the inner door liner 36. A peripheral recess 86 is formed around the flange 82 for receiving a fiber glass or asbestos gasket 88. A tempered glass pane 92 is placed over the window opening 80 and it tends to compress the gasket 88 slightly to form a reliable resilient sealing action against the escape of heat, vapors, grease and the like. A continuous window frame 94 is positioned around the peripheral edge of the glass pane 92 and attached to the outer window frame 84 by means of screw fasteners 96. This window frame 94 has a frontwardly turned peripheral flange 98 on the frontmost side of the pane 92.

A layer of thermal insulating material 100 such as fiber glass or the like is positioned within the inner door liner 36 in the area surrounding the glass pane 92. This insulation is formed in batts and cut into a series of small intricate shapes to fit snugly in place behind reinforcing gussets, around brackets, or screws and the like. A corner gusset 104 is shown near the bottom portion of the inner door liner 36.

A sheet metal insulation guard 106 is positioned against the insulation to hold it in place. The insulation guard also has a window opening 108 so as not to block the glass pane 92. This window opening 108 is defined by a rearwardly turned flange 110 which telescopes with the flange 98 of the window frame 94 to form a maze or labyrinth that prevents any fiber glass dust from migrating onto the interior surface of either glass pane 70 or 92. Suitable screw fasteners 112 fasten the insulation guard 106 to the outer window frame 84.

The insulation guard 106 is provided with a frontwardly facing flange 114 just beneath the window opening 108 and it nearly touches the interior side of the outer door panel 34 so as to substantially divide or partition the interior of the door from the outer door panel to the inner door liner, especially in the area beneath the window opening, so as to retard air flow and hence air-borne soil up between the two glass panes.

The hottest area of the door is along the top portion of the outer door panel 34. If conditions warrant it, air inlet slots 116 may be formed in the top edge of the flange 66 of the outer door panel 34. To supplement these slots, air outlet slots 118 may be formed along the top edge of the flange 40. Another measure that might be taken is to add a layer of aluminum foil 120 completely across the interior surface of the outer door panel 34 in the area above the window opening 64.

Figure 3:
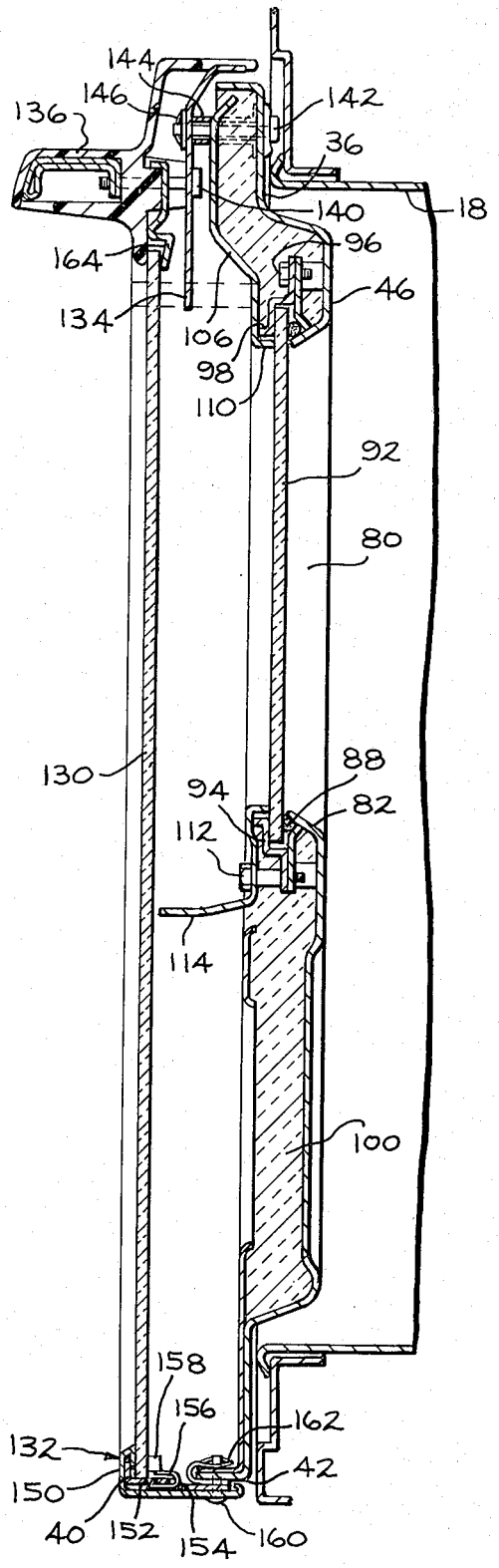
FIG. 3 is a cross-sectional side elevational view similar to that of FIG. 2 of a second modification of this invention where the outer door panel comprises a full glass pane that is encircled with a narrow decorative trim frame.

A second modification of the present invention is shown in FIG. 3. Elements in this modification which are identical or nearly identical with similar elements of FIG. 2 are given the same reference numerals. This includes most of the rearmost half of the door such as the inner door liner 36, embossment 46, window opening 80, glass pane 92, insulation 100, insulation guard 106, flange 114 and many more elements as numbered on the drawing.

The main departure in the design of FIG. 3 is the full glass front pane 130 to replace the smaller glass pane 70 of FIG. 2. This pane 130 is supported by a three-sided decorative trim frame 132 which extends across the bottom edge of the pane 130 and up the two sides thereof. A strong mounting plate 134 is fastened across the top portions of the two side members of the trim frame 132.

A molded plastic handle formation 136 is arranged across the top edge of the door to represent the fourth side of the trim frame 132 and the outer door panel of this modification. The handle formation 136 is supported from the mounting plate 134 by a screw fastener 140. Another screw fastener 142 extends from the inside surface of the door through the inner door liner 36, and through a tubular spacer 144, and through the mounting plate 134 to which it is attached by a Tinnerman Speed-Nut fastener 146. Of course, there is more than one fastening screw 140 and 142. There would be at least two of each and perhaps more.

The nature of the trim frame 132 is best shown at the bottom of FIG. 3. There is a thin gauge, stainless steel moulding 150 which slips over the trim frame. A pair of adjoining slots 152 and 154 are formed in the flange 40 for receiving a spring clip 156 for attachment therein. The spring clip has spring fingers 158 for pressing against the edge of the glass pane 130 and holding it in place. Similar spring clips 156 would be mounted along the bottom and the vertical sides of the trim frame 132. The flange 40 of the outer door panel is attached to the flange 42 of the inner door liner 36 by means of screw fasteners 160 that are threaded into Tinnerman Speed-Nut fasteners 162. At the top of the door, spring clips 164 are attached to the inner side of the plastic door handle formation 136 for engaging and pressing the glass pane in place.

Modifications of this invention will occur to those skilled in this art, therefore, it is to be understood that this invention is not limited to the particular embodiments disclosed, but that it is intended to cover all modifications which are within the true spirit and scope of this invention as claimed.

I claim:

1. An oven door construction comprising an outer door panel and a rearwardly spaced inner door liner, the outer door panel having a rearwardly facing peripheral flange, said inner door liner having a frontwardly facing peripheral flange telescoped with the flange of the outer door panel, a first window opening formed in the outer door panel, a single glass pane sealed over the said window opening, a second window opening formed in the inner door liner, and a second single glass pane sealed over the second window opening so that the two glass panes are widely spaced apart and are mounted independently of each other so there is no direct heat conductive path between the two glass panes, widely spaced fastening means of relatively low heat conductivity joined between the outer door panel and the inner door liner along the bottom edge and adjacent the top edge of the door, a layer of thermal insulation within the inner door liner surrounding the second glass pane, and an insulation guard fastened within the inner door liner, said insulation guard having a window opening in general alignment with the said second window opening, the insulation guard including a frontwardly facing flange just beneath the second window opening which reaches to the outer door panel and serves to substantially divide the interior of the door from the outer door panel to the inner door liner and retard air flow and hence air-borne soil up between the two glass panes.

2. An oven door construction as recited in claim 1 wherein the said second glass pane is sealed by a resilient gasket arranged around the periphery on the outer side thereof, a window frame clamped over the periphery of the inner side of the second glass pane, the said insulation guard having a flange surrounding its window opening which overlies the said window frame to form a pair of telescoping flanges to restrict portions of the thermal insulation from reaching the second glass pane.

3. An oven door construction as recited in claim 1 wherein the said insulation guard terminates just beneath the said second window opening, so that the said frontwardly facing flange of the guard also serves to restrict the movement of portions of the thermal insulation originating beneath the said frontwardly facing flange from reaching either one of the two glass panes.

4. An oven door construction as recited in claim 3 wherein an air vent means is formed along the top edge of the door, the said insulation guard having a peripheral flange surrounding its window opening and engaging the said second window pane, and a window frame surrounding the said peripheral flange and engaging the edge of the second pane, and means for fastening the window frame to the interior of the inner door liner, whereby the interaction of the said peripheral flange and the window frame serves to seal portions of the thermal insulation from entering the area between the two glass panes.

5. An oven door construction as recited in claim 4 wherein the said first glass pane is about the same size as the said second glass pane.

6. An oven door construction as recited in claim 4 wherein the said first glass pane is almost equal in size to the overall size of the outer door panel.

* * * * *